US008739486B2

(12) United States Patent
Bodsford et al.

(10) Patent No.: US 8,739,486 B2
(45) Date of Patent: Jun. 3, 2014

(54) INSULATED BUILDING STRUCTURE AND APPARATUS THEREFOR

(76) Inventors: Stan Bodsford, Kernersville, NC (US); Dan Carney, Concord, NC (US)

( * ) Notice: Subject to any disclaimer, the term of this patent is extended or adjusted under 35 U.S.C. 154(b) by 62 days.

(21) Appl. No.: 13/006,807

(22) Filed: Jan. 14, 2011

(65) Prior Publication Data

US 2011/0173913 A1 Jul. 21, 2011

Related U.S. Application Data

(60) Provisional application No. 61/296,256, filed on Jan. 19, 2010.

(51) Int. Cl.
*E04B 1/74* (2006.01)
*E04B 1/38* (2006.01)

(52) U.S. Cl.
USPC ..... 52/506.05; 52/404.2; 52/742.12; 52/712

(58) Field of Classification Search
CPC ..... E04D 13/1618; E04D 13/1625; E04D 13/1637; E04D 3/3602
USPC ..... 52/407.4, 404.2, 404.3, 742.1, 742.12, 52/409–412, 506.05, 512, 712, 714, 715
See application file for complete search history.

(56) References Cited

U.S. PATENT DOCUMENTS

| | | | | | |
|---|---|---|---|---|---|
| 2,256,961 | A | * | 9/1941 | Pearson et al. | 52/407.4 |
| 2,822,764 | A | * | 2/1958 | Widman | 52/405.1 |
| 4,081,938 | A | * | 4/1978 | Bertacchi et al. | 52/410 |
| 4,248,021 | A | * | 2/1981 | Dyer | 52/404.1 |
| 4,314,428 | A | * | 2/1982 | Bromwell | 52/22 |
| 4,333,292 | A | * | 6/1982 | Musgrave | 52/404.2 |
| 4,361,993 | A | * | 12/1982 | Simpson | 52/222 |
| 4,516,371 | A | | 5/1985 | Simpson | |
| 4,602,468 | A | * | 7/1986 | Simpson | 52/410 |
| 4,651,489 | A | * | 3/1987 | Hodges et al. | 52/409 |
| 4,651,493 | A | * | 3/1987 | Carey | 52/710 |
| 4,747,249 | A | * | 5/1988 | Bell et al. | 52/543 |
| 4,982,542 | A | * | 1/1991 | Funaki | 52/770 |
| 5,085,023 | A | * | 2/1992 | Duffy | 52/410 |
| 5,425,209 | A | * | 6/1995 | Funaki | 52/359 |

(Continued)

FOREIGN PATENT DOCUMENTS

| | | |
|---|---|---|
| FR | 2873139 | 1/2006 |
| GB | 2062721 | 5/1981 |

(Continued)

OTHER PUBLICATIONS

Roof Rack Brochure,Fletcher Insulation, [online], [retrieved on Oct. 19, 2011] Retrieved from the Internet <URL: http://www.insulation.com.au/_webapp_1082216/Roof_Rack™>.
Roof Rack Data Sheet,Fletcher Insulation, [online], [retrieved on Oct. 19, 2011] Retrieved from the Internet <URL: http://www.insulation.com.au/_webapp_1082216/Roof_Rack™>.

*Primary Examiner* — Elizabeth A Plummer
(74) *Attorney, Agent, or Firm* — Trego, Hines & Ladenheim, PLLC

(57) ABSTRACT

A bracket apparatus for an insulated building structure includes: a sheathing mounting element including a mounting surface configured to receive a mechanical fastener; and at least one elongated spacer extending away from the sheathing mounting element by a predetermined stand-off distance, the spacer configured to penetrate fibrous insulation, and defining a contact pattern configured to prevent pivoting motion of the spacer relative to a planar surface.

14 Claims, 7 Drawing Sheets

(56) References Cited

U.S. PATENT DOCUMENTS

| | | | | |
|---|---|---|---|---|
| 5,442,890 | A * | 8/1995 | Fligg | 52/742.12 |
| 5,857,292 | A * | 1/1999 | Simpson | 52/22 |
| 8,141,312 | B1 * | 3/2012 | Koble et al. | 52/551 |
| 2010/0146891 | A1 * | 6/2010 | Oliver et al. | 52/302.1 |
| 2011/0041451 | A1 * | 2/2011 | Lutkajtis et al. | 52/698 |
| 2012/0124930 | A1 * | 5/2012 | McClure | 52/404.3 |

FOREIGN PATENT DOCUMENTS

| | | |
|---|---|---|
| GB | 2395205 | 5/2004 |
| WO | 03078753 | 9/2003 |
| WO | WO 03078753 A1 * | 9/2003 |

* cited by examiner

INSULATED BUILDING STRUCTURE AND APPARATUS THEREFOR

CROSS-REFERENCE TO RELATED APPLICATIONS

This application claims the benefit of Provisional Application No. 61/296,256, filed Jan. 19, 2010.

BACKGROUND OF THE INVENTION

This invention relates generally to building structures and more particularly to apparatus for accommodating the installation of thermal insulation in such buildings.

One well-known type of building structure is a so-called "metal building" in which a series of spaced-apart structural steel frames are erected on a foundation and then covered with metallic sheathing.

In general it is considered desirable to include as much thermal insulation as possible in all types of buildings to minimize heat gain and loss, and consequently minimize energy expenditures for heating and cooling. Furthermore, in recent times government building codes have come to require much more insulation in wall and roof structures than in the past.

The roof and wall structures of conventionally-constructed metal buildings are not well adapted to the installation of large amounts of insulation. In particular, the structure and methods used to install roof sheathing crush the insulation to a small thickness at the sheathing mounting points, seriously degrading the insulation's performance.

Methods are available to prevent crushing the insulation in a metal building. They typically involve the installation of a grid or net of straps underneath an existing roof structure, which is then used to support the insulation. Unfortunately, these methods require a great deal of labor and materials, and result in high costs.

BRIEF SUMMARY OF THE INVENTION

These and other shortcomings of the prior art are addressed by the present invention, which provides a structure suitable for installing insulation without crushing.

According to one aspect of the invention, a bracket apparatus includes: a sheathing mounting element including a mounting surface configured to receive a mechanical fastener; and at least one elongated spacer extending away from the sheathing mounting element by a predetermined stand-off distance, the spacer configured to penetrate fibrous insulation, and defining a contact pattern configured to prevent pivoting motion of the spacer relative to a planar surface.

According to another aspect of the invention, an insulated building structure includes: an array of spaced-apart elongated structural members; an array of spaced-apart elongated intermediate members interconnecting the spaced-apart structural members; a layer of thermal insulation lying across the array of intermediate members; a plurality of spacers positioned in contact with the intermediate members, each spacer penetrating the thermal insulation and extending away from the associated intermediate member by a predetermined stand-off distance; and a plurality of sheathing mounting elements positioned in contact with the spacers, each sheathing mounting element including a mounting surface exposed outside the thermal insulation that is configured to receive a mechanical fastener.

According to another aspect of the invention, a method is provided for insulating a building structure having an array of spaced-apart elongated structural members and an array of spaced-apart elongated intermediate members interconnecting the spaced-apart structural members, and a layer of thermal insulation lying across the array of intermediate members. The method includes: positioning a plurality of spacers in contact with the intermediate members, each spacer penetrating the thermal insulation and extending away from the associated intermediate member by a predetermined stand-off distance; and positioning a plurality of sheathing mounting elements in contact with the spacers, each sheathing mounting element including a mounting surface exposed outside the thermal insulation that is configured to receive a mechanical fastener.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
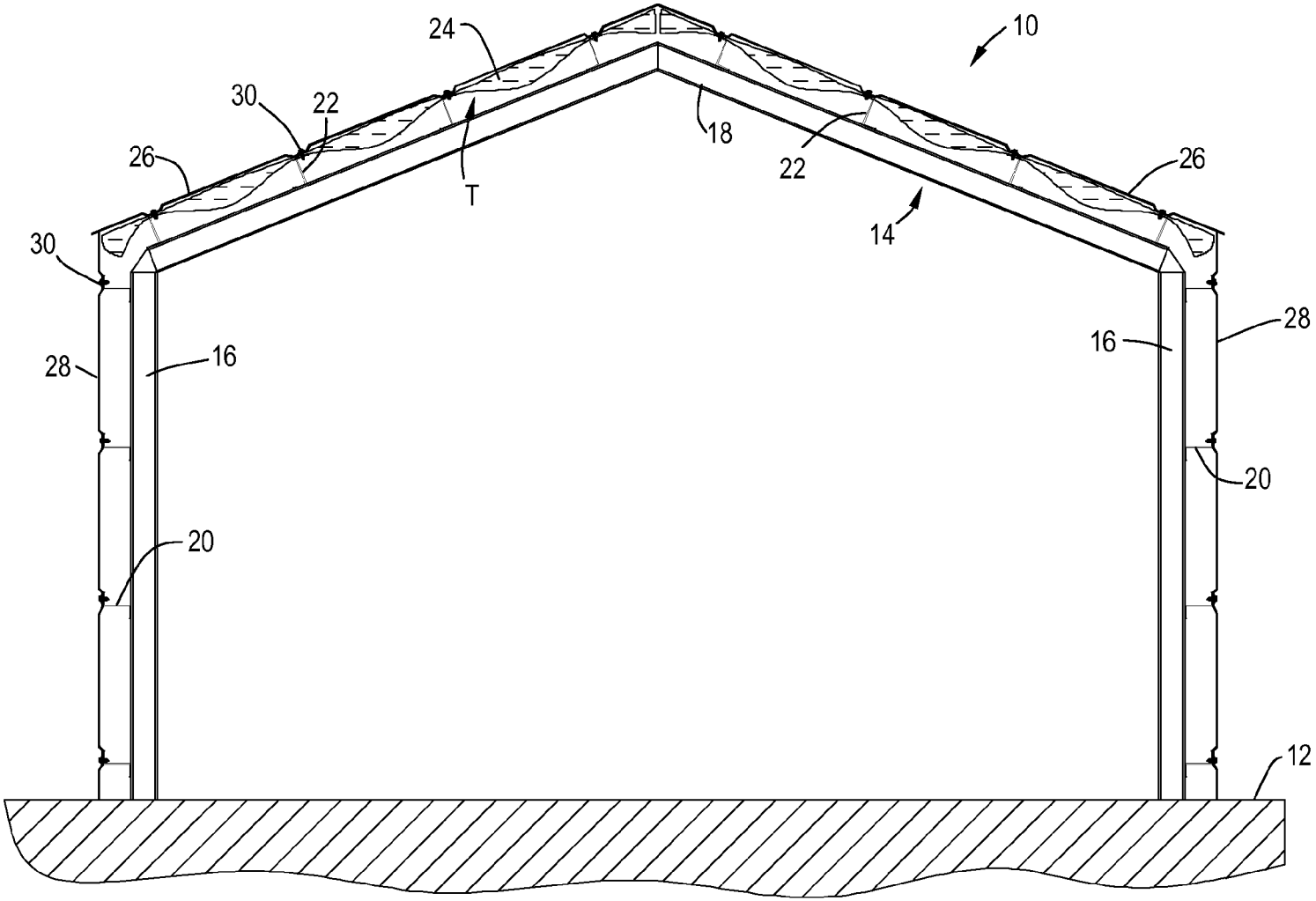
FIG. 1 (PRIOR ART)
FIG. 1 is a cross-sectional view of a portion of the structure of a prior art building.

Referring to the drawings wherein identical reference numerals denote the same elements throughout the various views, FIG. 1 depicts a portion of the structure of a building 10, which is constructed in a known manner on top of a concrete slab 12 or other suitable foundation. The building is of a type generally referred to in the construction industry simply as a "metal building". Structural support for the building is provided by a series of spaced-apart frames 14. Each of the frames 14 is generally an inverted "U" shape and is built up from spaced-apart posts 16 interconnected by rafters 18. In a typical building of this type, the posts 16 and rafters 18 are steel I-beam elements which are fastened together using suitable brackets and fasteners (e.g. bolts or rivets). The term "structural member" may be used herein to refer generically to both the posts 16 and rafters 18.

A series of elongated, horizontally-oriented members are attached to the outer surfaces of the frames 14 at regular intervals. These members serve as a rigid intermediate structure to which the outer sheathing of the building is attached. In common construction parlance the members attached to the posts 16 are referred to as "girts" 20, and the members attached to the rafters 18 are referred to as "purlins" 22. The term "intermediate member" may be used herein to refer generically to both the girts 20 and purlins 22.

In the illustrated example, each of the girts 20 and the purlins 22 is a member formed from sheet metal having a generally "Z"-shaped cross-section. Other sectional shapes, such as "C" and "hat" are known as well. The girts 20 and purlins 22 would typically be attached to the posts 16 and rafters 18 using mechanical fasteners such as bolts and nuts.

Insulation 24 is laid over the purlins 22. A frequently-used type of insulation comprises a thick mat of glass fibers (e.g. "fiberglass") in the form of a blanket, roll or batt. As an example, in its free state the insulation 24 would typically be about 10 cm (4 in.) to about 20 cm (8 in.) thick with a corresponding thermal resistance or "R-value" of about 12 to 25. Typically the underside of the insulation 24 would include a paper facing and/or vapor barrier material.

Roof sheathing 26 and siding 28 is secured to the purlins 22 and the girts 20, respectively. The sheathing 26 and siding 28 are pressed sheet metal shapes, and are often attached using self-drilling screws 30 of a known type. The insulation 24 is crushed or compressed to a very small thickness, for example less than about 1.3 cm (½ in.) at the attachment points over the purlins 22. This crushing greatly reduces the R-value of the insulation 24 not only at the points of minimum thickness, but also in the transition regions "T" on either side of each purlin 22. When large areas of insulation 24 are installed over many purlins 22, the total degradation in insulation performance can be significant.

Figure 2:
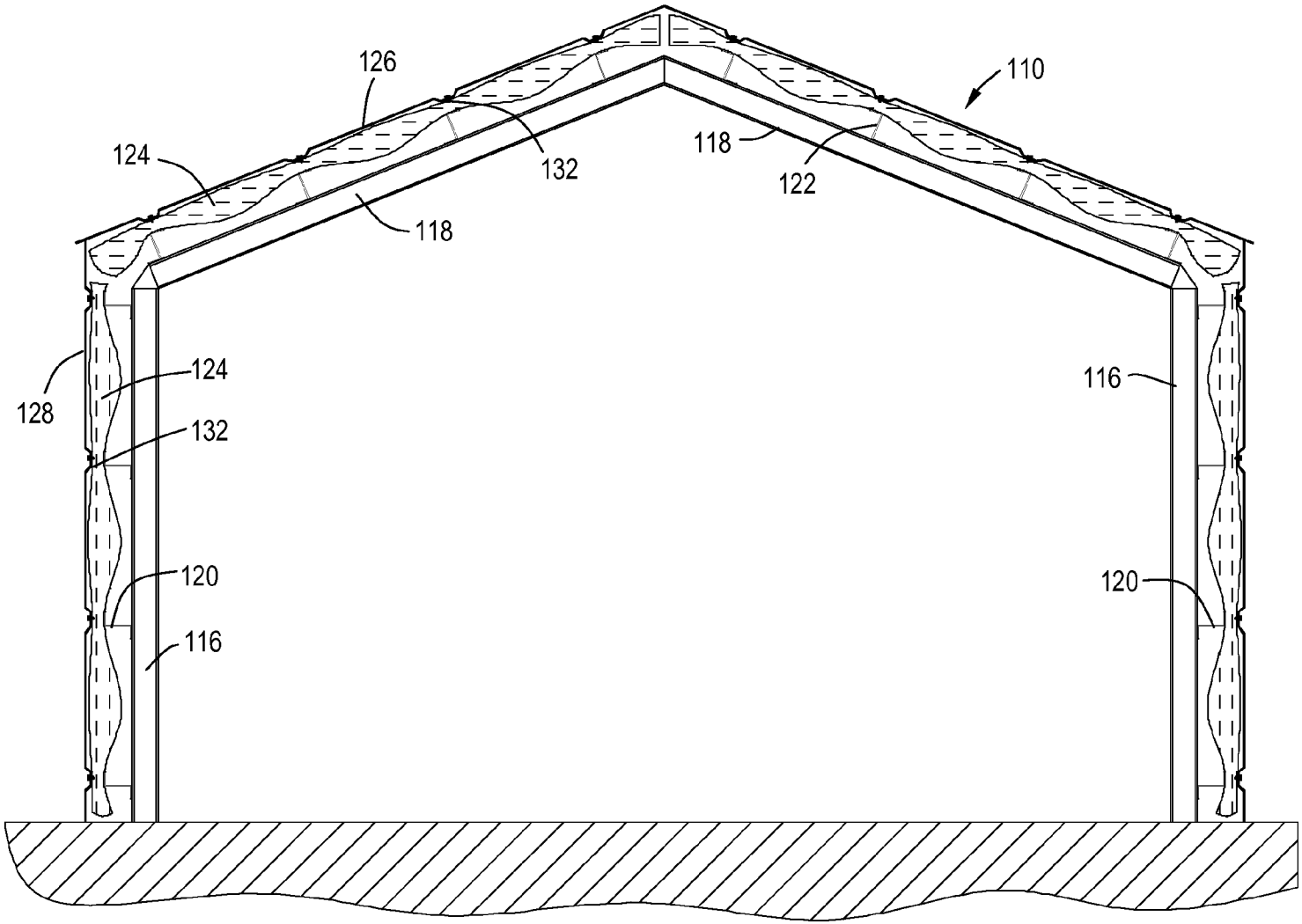
FIG. 2 is a cross-sectional view of a portion of the structure of a building constructed according to an aspect of the present invention.

FIG. 2 illustrates a portion of the structure of a building 110 which is constructed in accordance with the principles of the present invention. The building 110 is generally similar in construction to the building 10, and includes posts 116, rafters 118, girts 120, purlins 122, insulation 124, sheathing 126, and siding 128. The building 110 differs in the manner in which the insulation 124 is installed. In particular, brackets 132 of a unique configuration are attached to the purlins 122 through the insulation 124, and the roof sheathing 126 is attached in turn to the brackets 132.

Figure 3:
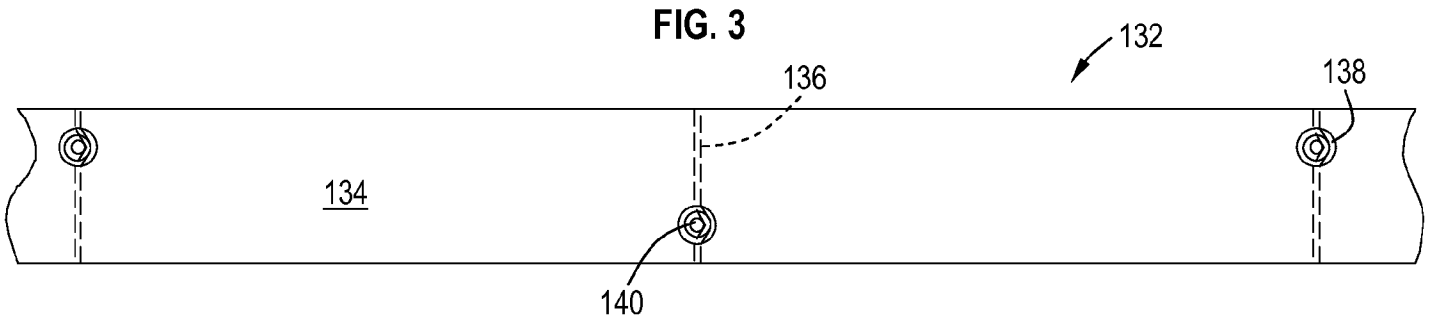
FIGS. 3, 4, and 5 are top, side, and cross-sectional views, respectively, of a bracket constructed according to an aspect of the present invention.
Figure 4:
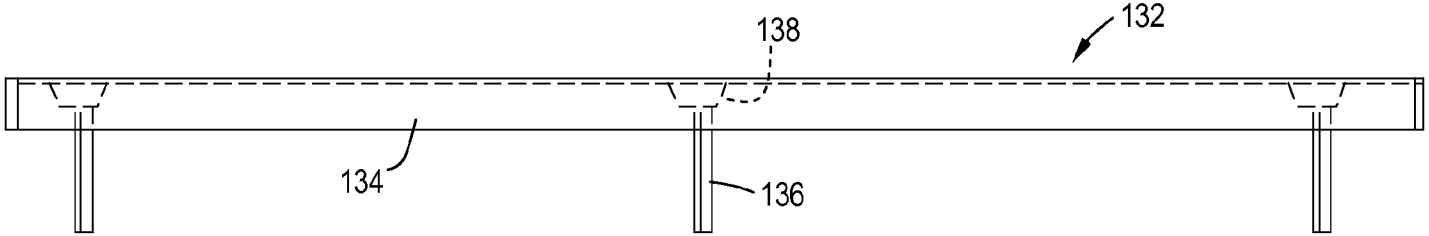
Figure 5:
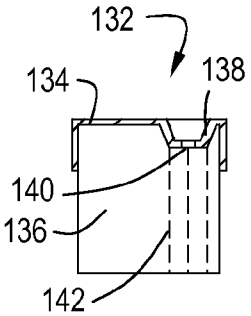

FIGS. 3-5 show a short section of one of the brackets 132 in more detail. It will be understood that the bracket 132 could be produced in any length determined to be convenient and economical. The basic components of the bracket 132 are a sheathing mounting element and one or more spacers. As will be understood from examination of the examples described further below, the specific mechanical configuration of the bracket 132 is not critical so long as the bracket 132 provides an element with a small surface area for holding the sheathing 126 at a stand-off distance from the purlins 122, and some means for accepting fasteners to secure the sheathing 126. In the specific example shown in FIGS. 3-5, the mounting element is an elongated sheet metal channel 134 having an inverted "U"-shape with a web and downturned flanges. The spacers 136 take the form of sheet-metal plates which extend downward from the inner surface of the channel 134. The spacers 136 may take any convenient shape and may be attached to the channel 134, for example by welding or brazing, by adhesive, or by mechanical fasteners such as rivets or screws, or by a mechanical joint such as a crimp. The lateral extension of the spacers 136 across the channel 134 provides a contact pattern which is "self-balancing" or configured to prevent pivoting motion of the bracket 132 relative to the associated intermediate member (or other planar surface) when installed.

The channel 134 includes a number of recesses 138 which surround fastener holes 140 formed through the web. The purpose of the recesses 138 is to receive the heads of fasteners such self-drilling screws, so as to provide a flat top surface when the sheathing 126 is installed. The recesses 138 are believed to make installation of sheathing 126 over the channel 134 easier, but are strictly optional. The fastener holes 140 (and their associated recesses 138) may be offset relative to the centerline of the channel 134 in order to provide a more stable mounting, as well as to reduce the chance that a fastener will be struck when sheathing 126 is attached to the channel 134. An example of a suitable distance between the fastener holes 140 along the length of the bracket 132 is about 30.5 cm (12 in.).

To accommodate fasteners, the portions of the spacers 136 which would otherwise be aligned with the fastener holes 140 have shallow grooves 142 formed therein, for example by stamping. Fasteners could also be accommodated by using tubes or hollow construction for the spacers 136, or by offsetting the spacers 136 so they are not aligned with the fastener holes 140. The spacers 136 could also be made in two separate pieces, with one piece being placed on each side of the fastener hole 140.

The specific materials for the components of the bracket 132 may be varied to suit a particular application in terms of thickness, dimensions, material selection, and coatings. One particular material known to be suitable for this application is sheet steel coated with 55% aluminum-zinc alloy and sold commercially as GALVALUME, which is available from BIEC International, Inc., Vancouver, Wash. 98660 USA. In the specific example discussed, the thickness of the bracket components is in the range of about 1.2 mm (0.048 in. or 18 gage) to about 1.9 mm (0.075 in. or 14 gage).

Figure 6:
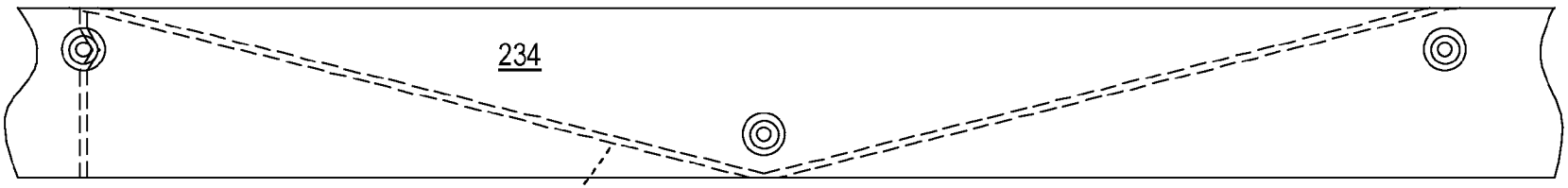
FIGS. 6 and 7 are top and side views, respectively, of an alternative bracket constructed according to an aspect of the present invention.
Figure 7:
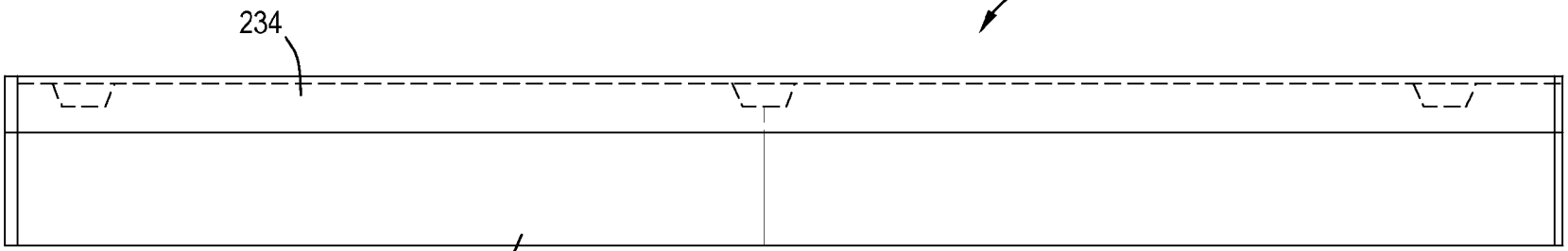

FIGS. 6 and 7 illustrate an alternative bracket 232 which includes a channel 234 and a single continuous sheet metal spacer 236 having a saw-tooth shape. The spacer 236 may be attached to the channel 234, for example by welding or brazing, by adhesive, or by mechanical fasteners such as rivets or screws, or by a mechanical joint such as a crimp. The lateral extension of the spacer 236 provides a contact pattern which is "self-balancing" or configured to prevent pivoting motion of the spacer 236 relative to the associated intermediate member (or other planar surface) when installed. Therefore, alternatively, it may be provided as a separate element from the channel 234.

Figure 8:
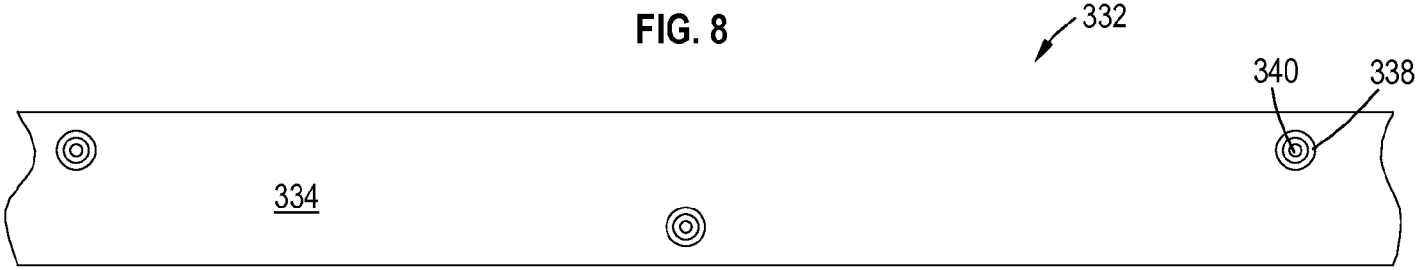
FIGS. 8, 9, and 10 are top, side, and cross-sectional views, respectively, of another alternative bracket constructed according to an aspect of the present invention.
Figure 9:
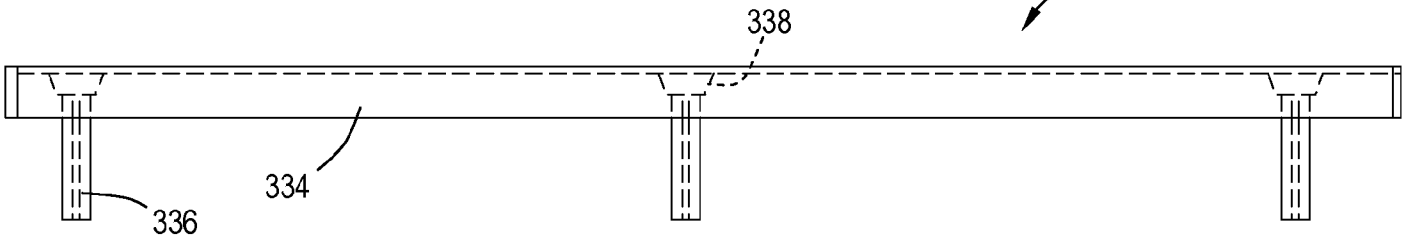
Figure 10:
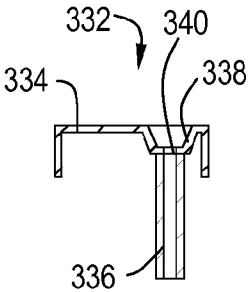

FIGS. 8, 9, and 10 illustrate yet another alternative bracket 332 which includes a channel 334 and a plurality of tubular spacers 336. The channel 334 includes a number of recesses 338 which surround fastener holes 340. The spacers 336 are secured to the bottom surfaces of the recesses 338 in alignment with the fastener holes 340, and may be attached, for example, by welding or brazing, by adhesive, or by mechanical fasteners such as rivets or screws, or by a mechanical joint such as a crimp. The lateral spacing of the spacers 336 across the channel 334 provides a contact pattern which is "self-balancing" or configured to prevent pivoting motion of the bracket 332 relative to the associated intermediate member (or other planar surface) when installed.

Figure 11:
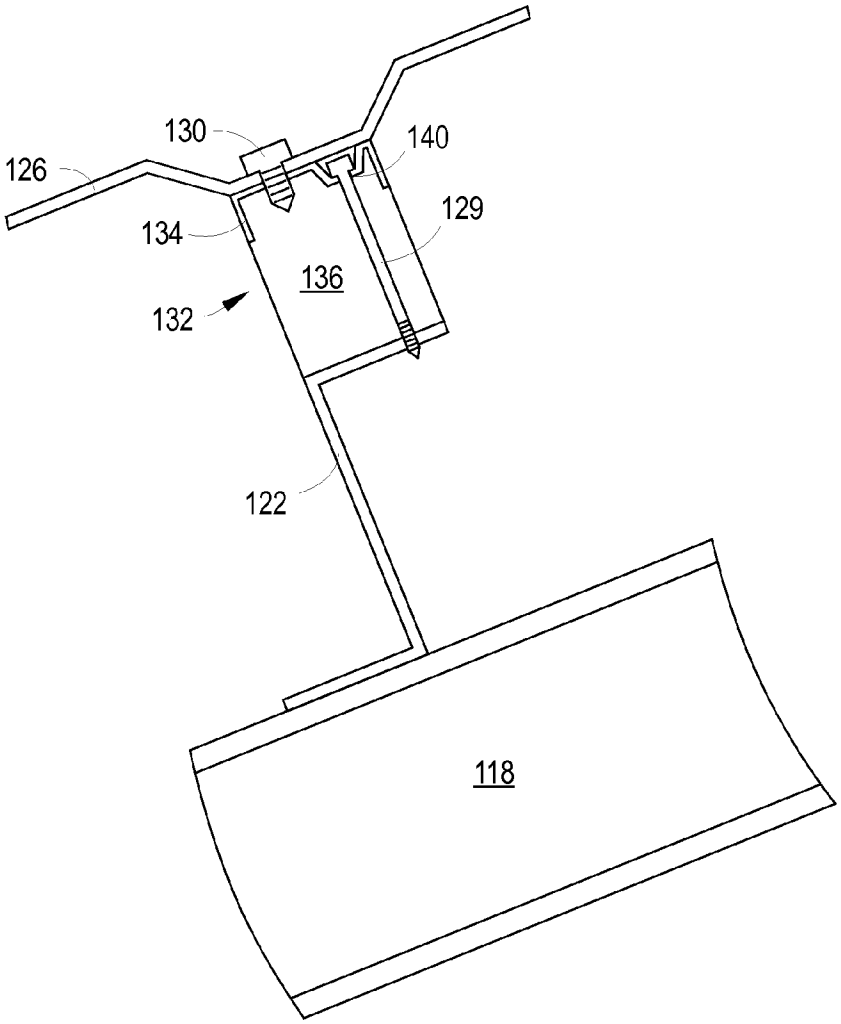
FIG. 11 is a cross-sectional view of a portion of a building structure, showing details of attachment of a bracket thereto.

Using the bracket 132 described above as an example, and referring to FIG. 2, insulation 124 may be installed as follows. Once the frames and purlins 122 are installed, the insulation 124 may be laid over the purlins 122 as in conventional practice. Then, the brackets 132 are installed to the purlins 122 by pushing the brackets 132 through the insulation 124. The spacers 136 have a very small surface area and consequently may be expected to "cut" or "stab" (or otherwise penetrate) through the insulation 124 in order to contact the underlying purlins 122 without crushing the insulation 124. FIG. 11 depicts a small section of the structure with the insulation removed so that the relationship of the bracket 132 and purlin 122 is visible. Once the bracket 132 is laid in place, it is secured with appropriate fasteners, such as self-drilling screws 129, passing through the fastener holes 140 and into the purlins 122. The sheathing 126 may then be attached to the brackets 132, again with conventional fasteners such as self-drilling screws 130.

When completed, the brackets 132 provide a definite stand-off distance between the sheathing 126 and the purlins 122, in effect guaranteeing that a minimum effective amount of insulation 124 will be present across the entire surface area of the roof. In the illustrated example the stand-off distance is about 7.6 cm (3 in.) to about 12.7 cm (5 in.), but this distance may be varied over a wide range to suit a particular application or building code requirement. Because the spacers 136 have a very small surface area for their length, they contribute only a minimum amount of heat transfer between the sheathing 126 and the purlins 122. As an illustration of this property, it is noted that the length-to-thickness ratio of the exemplary spacers 136, using the example dimensions described above, and measured parallel to the stand-off distance, is about 40 or more.

Figure 12:
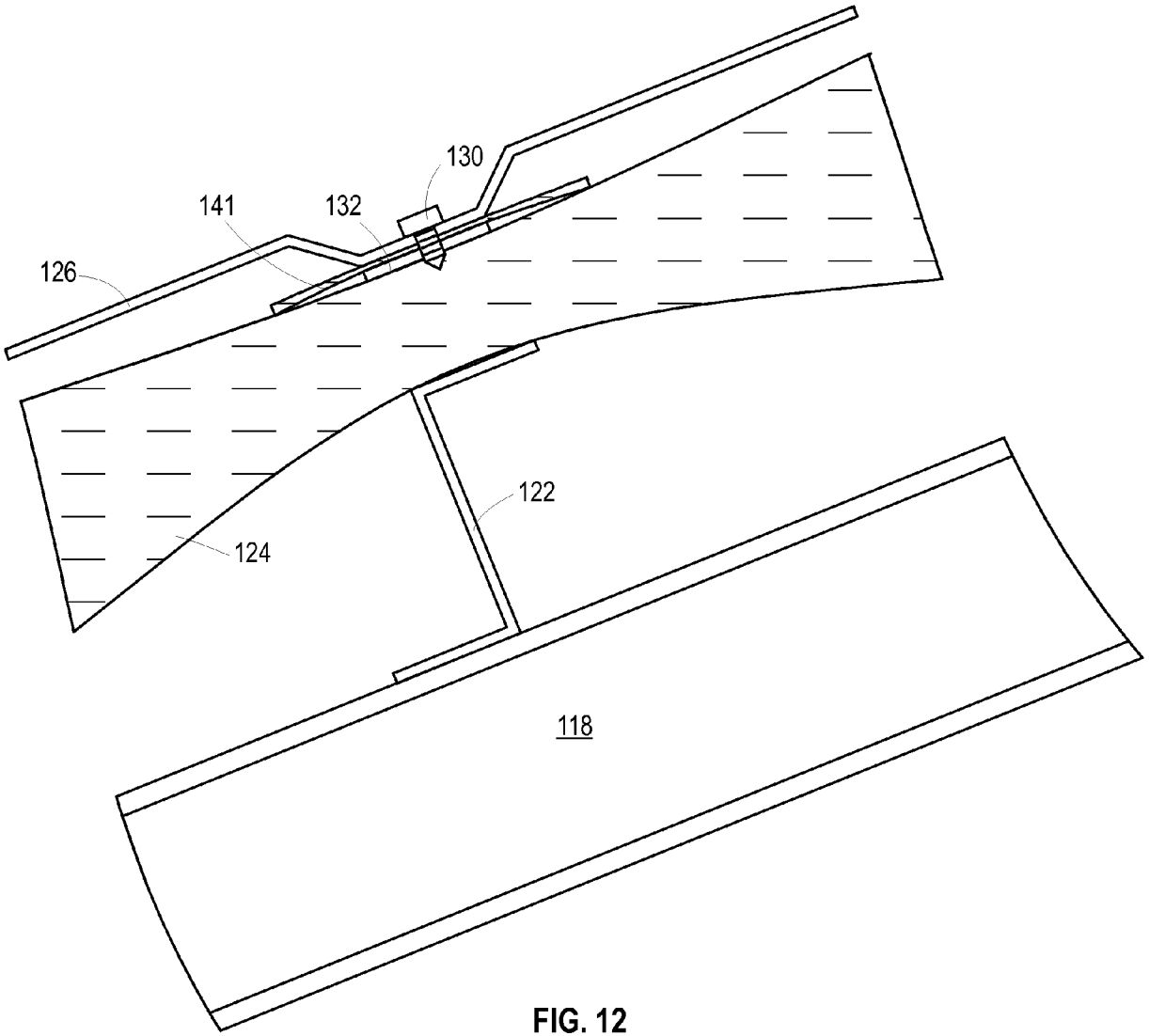
FIG. 12 is a cross-sectional view of a portion of a building structure, showing the installation of supplemental insulation.

To further enhance the effectiveness of the insulation 124, and mediate any heat transfer effect of the brackets 132, supplemental insulation may be provided. FIG. 12 depicts a strip of supplemental insulation 141 which is laid over the bracket 132. Its major dimension is parallel to the purlin 122 and it extends laterally across the portion of the insulation 124 which is compressed by the bracket 132. In the illustrated example, the supplemental insulation 141 is about 6.4 mm (¼ in.) thick before installation, and approximately 20 cm (8 in.) wide, measured parallel to the rafter 118. The outer surface of the supplemental insulation 141 is faced with foil to reduce radiant heat losses, and the inner surface of the supplemental insulation 141 is faced with plastic to act as a vapor barrier. During installation, the sheathing 126 is placed over the supplemental insulation 141 and then the fasteners (e.g. self-tapping screws 130) are driven through the sheathing 126, the supplemental insulation 141, and the brackets 132.

It should be noted that the construction technique described for the roof of the building 110 may be applied with equal effectiveness to the wall structure. As seen in FIG. 2, brackets 132 may be attached to the girts 120 and additional insulation may be applied between the girts 120 and the siding 128. This is in stark contrast to conventional practice, which would require the construction of a secondary wall structure inside the building in order to support wall insulation.

The structure described above provides numerous advantages over prior art "metal building" construction. In particular, it allows the installation of insulation so that it will be effective with low labor and materials costs.

The foregoing has described an insulated building structure. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A bracket apparatus for an insulated building structure, comprising:

a sheathing mounting element including a mounting surface configured to receive a mechanical fastener; and a spacer attached to the sheathing mounting element and extending away from the sheathing mounting element by a predetermined standoff distance, wherein the spacer defines a contact pattern configured to prevent pivoting motion of the spacer relative to a planar surface and comprises a sheet-metal plate oriented perpendicular to the mounting surface, the sheet-metal plate including two spaced-apart lateral edges and terminating at a cutting edge that extends between the lateral edges; and wherein the sheathing mounting element comprises an inverted "U"-shape with a web and two spaced-apart flanges downturned over the spacer such that each of the flanges contacts and extends partially along a corresponding one of the lateral edges, leaving the cutting edge exposed between the two lateral edges, such that the spacer is configured to penetrate fibrous insulation by cutting action of the cutting edge.

2. The apparatus of claim 1 wherein the spacer has a ratio of length, measured parallel to the stand-off distance, to a thickness of the spacer, of about 40 or more.

3. The bracket assembly of claim 1 wherein the bracket includes a plurality of the spacers spaced apart along the length of the sheathing mounting element.

4. An insulated building structure comprising:

an array of spaced-apart structural members;

an intermediate member interconnecting the spaced-apart structural members, the intermediate member having a planar surface;

a layer of thermal insulation lying across the intermediate member;

a bracket comprising:

a sheathing mounting element including a mounting surface configured to receive a mechanical fastener;

a spacer attached to the sheathing mounting element and extending away from the sheathing mounting element by a predetermined standoff distance, wherein the spacer:

defines a contact pattern configured to prevent pivoting motion of the spacer relative to a planar surface;

comprises a sheet-metal plate oriented perpendicular to the mounting surface; and includes two spaced-apart lateral edges and terminates at a cutting edge that extends between the lateral edges; and wherein the sheathing mounting element comprises an inverted "U"-shape with a web and two spaced-apart flanges downturned over the spacer, such that each of the flanges contacts and extends partially along a corresponding one of the lateral edges, leaving the cutting edge exposed between the two lateral edges, such that the spacer is configured to penetrate fibrous insulation by cutting action of the cutting edge;

wherein the bracket is positioned with the cutting edge in contact with the intermediate member such that the spacer penetrates the thermal insulation and extends away from the intermediate member by the predetermined stand-off distance, such that the mounting surface is exposed outside the thermal insulation.

5. The structure of claim 4 further comprising exterior sheathing which overlies the thermal insulation and is attached to the mounting surface of the bracket.

6. The structure of claim 4 further comprising supplemental thermal insulation overlying the sheathing mounting element.

7. The structure of claim 4 wherein the spacer has a ratio of length, measured parallel to the stand-off distance, to a thickness of the spacer, of about 40 or more.

8. The insulated building structure of claim 4 wherein the bracket includes a plurality of the spacers spaced apart along the length of the sheathing mounting element.

9. The insulated building structure of claim 4 wherein the building structure includes a plurality of the intermediate members, the structure further comprising a plurality of the brackets, each of the brackets positioned in contact with a corresponding intermediate member.

10. A method of insulating a building structure having an array of spaced-apart structural members and an intermediate member interconnecting the spaced-apart structural members, and a layer of thermal insulation lying across the intermediate member wherein each the intermediate member includes a planar surface, the method comprising:

providing a plurality of brackets, each bracket comprising:

a sheathing mounting element including a mounting surface configured to receive a mechanical fastener;

a spacer attached to the sheathing mounting element and extending away from the sheathing mounting element by a predetermined standoff distance, wherein the spacer:

defines a contact pattern configured to prevent pivoting motion of the spacer relative to a planar surface; and comprises a sheet-metal plate oriented perpendicular to the mounting surface with two spaced-apart lateral edges and terminating at a cutting edge that extends between the two lateral edges; and wherein the sheathing mounting element comprises an inverted "U"-shape with a web and two spaced-apart flanges downturned over the spacer, such that each of the flanges contacts and extends partially along a corresponding one of the lateral edges, leaving the cutting edge exposed between the two lateral edges;

positioning the bracket in contact with the intermediate member by pushing the bracket, such that the spacer penetrates the thermal insulation by cutting action of the cutting edge and extends away from the intermediate member by the predetermined stand-off distance, and such that the mounting surface is exposed outside the thermal insulation.

11. The method of claim 10 further comprising positioning exterior sheathing overlying the thermal insulation and attaching the exterior sheathing to the mounting surface of the sheathing mounting element.

12. The method of claim 10 further comprising positioning supplemental thermal insulation overlying the sheathing mounting element.

13. The method of claim 10 wherein the bracket includes a plurality of the brackets spaced apart along the length of the sheathing mounting element.

14. The method of claim 10 wherein the building structure includes a plurality of the intermediate members, the method further comprising providing a plurality of the brackets and positioning each of the plurality of brackets in contact with a corresponding intermediate member.

* * * * *